US005368302A

United States Patent [19]

Thomas

[11] Patent Number: 5,368,302

[45] Date of Patent: Nov. 29, 1994

[54] GOLF PUTTER INCLUDING BALL RETRIEVING DEVICE

[75] Inventor: Felix L. Thomas, Lady Lake, Fla.

[73] Assignee: N.S.K. Golf Club, Inc., Navarre, Fla.

[21] Appl. No.: 980,186

[22] Filed: Nov. 20, 1992

[51] Int. Cl.[5] ..... A63B 69/36

[52] U.S. Cl. ..... 273/162 E; 273/174

[58] Field of Search ..... 273/162 E, 187.6, 164.2, 273/32 F, 173, 174

[56] References Cited

U.S. PATENT DOCUMENTS

| | | | |
|---|---|---|---|
| 1,960,110 | 5/1934 | Iles | 273/162 E |
| 3,374,027 | 3/1968 | Jacobs | 273/162 E X |
| 3,632,112 | 1/1972 | Jacobs | 273/162 E |
| 3,708,172 | 1/1973 | Rango | 273/162 E |
| 4,976,436 | 12/1990 | Serizawa | 273/162 E |

OTHER PUBLICATIONS

"Sharper Image Catalog", Spring 1993; Birdie Time Putter TS222.

*Primary Examiner*—George J. Marlo

*Attorney, Agent, or Firm*—Allen, Dyer, Doppelt, Franjola & Milbrath

[57] ABSTRACT

A golf putter is provided having a putter head with a bore therein capable of affixing to a golf ball and lifting it without the golfer having to bend over to pick it up from the ground and in particular capable of retrieving the ball resting at the bottom of a cup. The putter shaft contains a vertical portion at the shaft connection to the head dimensioned to lower the head into the cup. The combination of head size and orientation of the head to the shaft permits the successful removal of the golf ball from its resting position within the cup.

4 Claims, 2 Drawing Sheets

GOLF PUTTER INCLUDING BALL RETRIEVING DEVICE

FIELD OF THE INVENTION

The present invention is directed to golf clubs, and in particular to a putter having means for retrieving a golf ball from its resting place within a cup.

DESCRIPTION OF BACKGROUND ART

There are several important factors that a golfer considers before and during his round of golf. One factor is proper posture during the swing and although somewhat mundane and not always pleasant, his posture when lifting a golf bag or crouching and bending to pick up his golf ball from within the cup after having successfully sunk his putt.

Whether because of back problems of simply convenience, many golfers have created unique styles for lifting the golf ball from the ground or from within the cup. Certain putters are fashioned with a relatively flat trailing portion on the putter head. The head tapers to a narrow blade at the back side of the head. This blade portion is used to scoop up the ball and flip it into the air for catching by the golfer. With training, the golfer develops his particular style for using the putter blade in a manner for which it was not. originally designed, lifting a ball or removing the ball from within the cup. The benefit of not having to bend seems to outweigh the potential danger of damaging the club itself and the damage to the greed around the cup.

Devices adapted to fitting the golf ball have been developed that are fit to a shaft. Their primary purpose is for retrieving the ball from the bottom of a pond or out of difficult places to reach. Some of these devices have been adapted for attachment to the handle or the club. The club is held by the head end and the ball is retrieved by placing the device affixed onto the gripping handle end onto the ball. Suction-like devices made of a soft rubber material have been attached to the end of the shaft as pert of the handle grip. After the ball has come to rest in the bottom of the cup, the golfer holds the putter from the head end and causes the device to grab the ball within the cup. In some cases, ball retrieving devices have been modified and affixed to the putter head or have been made a part of the putter head for lifting the ball from the ground.

Many of the devices made to be affixed to the club head or handle have interfered with the primary purpose of the club, striking the ball. Additions to the handle interfere with proper gripping of the club. Additions to the putter head have not been able to incorporate popular putter head designs. Thus, the golfer concerned about bending or convenience finds that satisfying his need can only be accomplished by sacrificing or modifying his style or his equipment. The present invention relates to satisfying this need to retrieve the golf ball without bending to do so and in particular to retrieving the golf ball from within the cup as a natural function of the putter.

SUMMARY OF INVENTION

The present invention has as its objective to provide a putter capable of retrieving a golf ball from within a cup on a golfing green without sacrificing the putter head primary design function.

In one form, the putter comprises a club shaft having a proximal gripping end adapted to be held by the golfer, and a distal end. The distal end is configured to have a vertical portion of the shaft. The distal end is affixed to a club head. The club head bottom surface contains a bore sized to closely receive the golf ball. The club head has an upper surface and a bottom surface and is dimensioned to fit within the cup while keeping the bottom surface in a substantially horizontal position. The club shaft vertical portion length is sufficient to permit the head bottom surface to be lowered into the cup and affix the ball within the bottom surface bore.

To properly execute a putt, the golfer stands to a side of the ball laterally to a line from the ball to the cup. The preferred putter designs angle the putter shaft to the head for this reason. The invention angles the shaft from the gripping end to a bend in the shaft at the vertical distal end. The angle is preset for the golfer. The vertical portion has sufficient length to lower the bottom surface of the head to the golf ball resting at the bottom to the cup.

The club head bore is dimensioned to closely receive the golf ball. The diameter of the bore is proximate to the ball diameter. The depth of the bore is proximate to the ball radius. The depth of the bore can exceed the ball radius and can penetrate the upper surface of the head. The golf ball can then be removably affixed within the bottom surface of the head.

In a second embodiment, an insert is affixed to the putter head bottom surface. The insert contains the bore and a face of the putter. The insert material in one embodiment is substantially hard relative to a golf ball cover material. The insert has a closely machined bore with a diameter dimensioned proximate to the golf ball diameter and a bore depth at least proximate to the ball radius. An alternate insert is made from a soft material relative to the hardness of the golf ball cover.

By maintaining the shaft vertical portion length and the head bottom surface bore dimensions, a method for aiding the golfer in retrieving a golf ball resting within the cup is achieved.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

A preferred embodiment for a putter 10 used to retrieve a golf ball 14 from within a cup 14 located on a putting green 16 is described along with alternate embodiments for certain elements of the invention.

Figure 1:
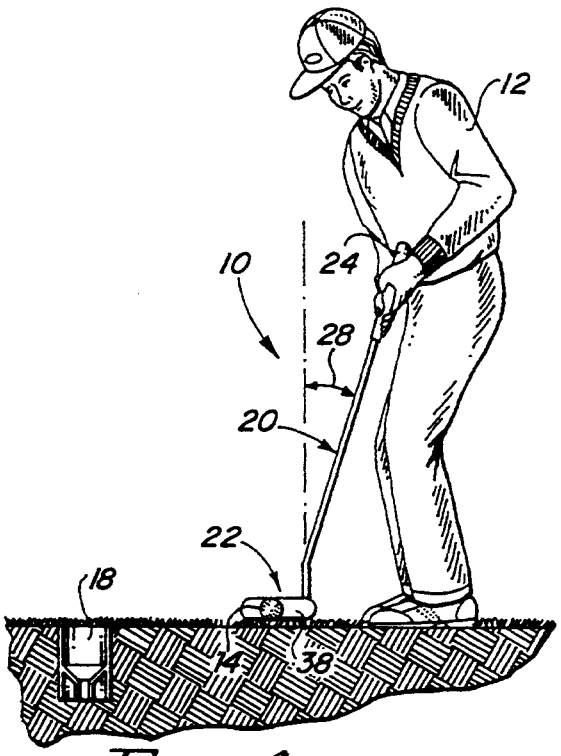
FIG. 1 illustrates a golfer positioned to strike a ball using a putter.
Figure 2:
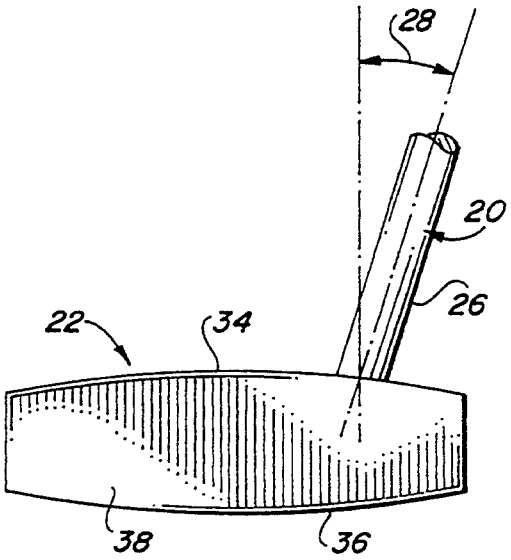
FIG. 2 is a partial front view of a putter illustrating a shaft angle between the putter shaft and head.
Figure 3:
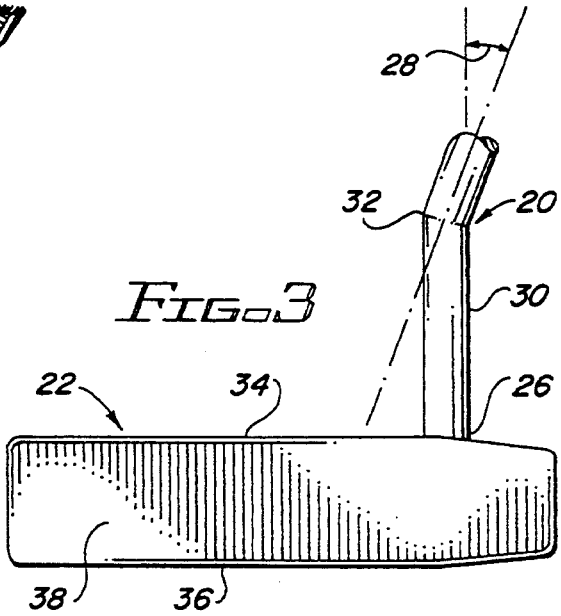
FIG. 3 is a partial front view of a putter having a shaft vertical portion.

A putter 10 traditionally used in the game of golf contains an elongated golf club shaft 20 having a distal end 26 and a proximal gripping end 24 that is held by a golfer 12 in his attempt to putt a golf ball 14 across a putting green surface 16 and into a cup 18 as illustrated in FIG. 1. The golfer addresses the ball 14 by standing laterally to a projected path over the green surface 16 from the ball 14 to the cup 18. To account for the laterally displaced position of the golfer 12 with respect to the ball 14, the shaft distal end 26 is affixed to a club head 22 at an angle 28 from a vertical to the head 22. The club head 22 is shaped so as to have an upper surface 34 and a bottom surface 36. The shaft distal end 26 is affixed to the head 22 at the head upper surface 34 as illustrated in FIG. 2. Variations in how the shaft 20 is affixed to the head 22 do exist as does the size of the angle 28. In some putter embodiments, the shaft distal end 26 has a vertical portion 30 affixed to the head 22 as illustrated in FIG. 3. A transition between this vertical portion 30 and the shaft proximal gripping end 24 is defined here as a bend 32. The invention adheres to the conventional features of the putter 10 and permits variations in style as will be discussed.

Figure 4:
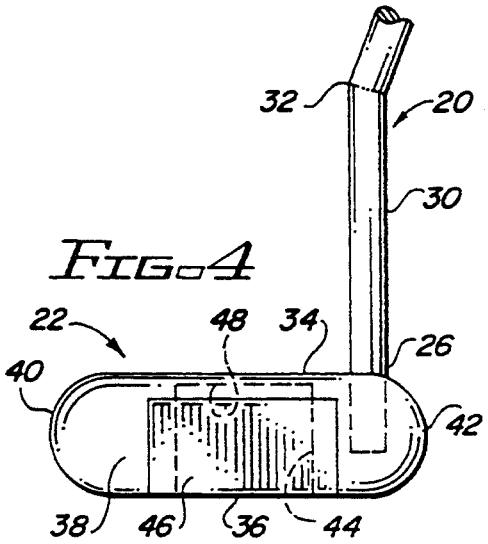
FIG. 4 is a front view illustrating the putter invention head having a bore and a shaft vertical portion.
Figure 6:
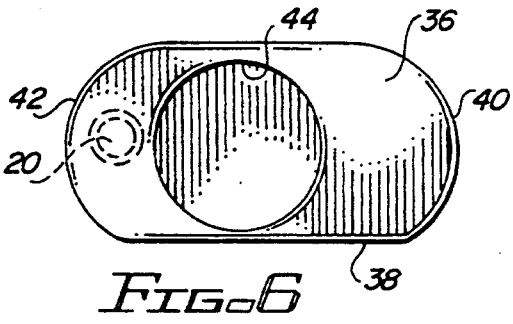
FIG. 6 is a bottom surface view of the putter invention.
Figure 5:
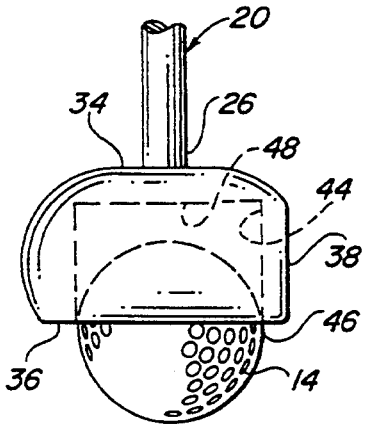
FIG. 5 is a partial view from a side of the invention, wherein a golf ball is shown removably affixed within the head bottom surface bore.
Figure 7:
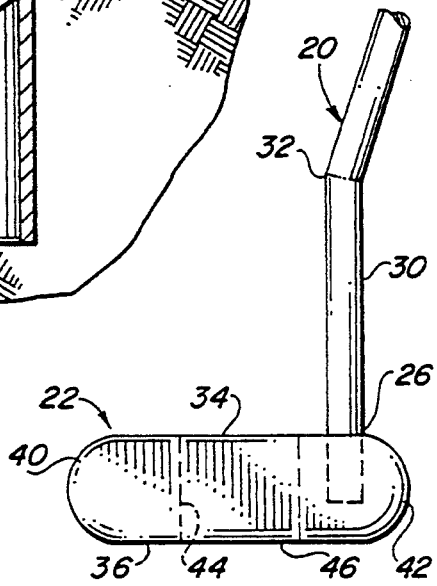
FIG. 7 is a front view illustrating the putter invention head having a bore and a shaft vertical portion, wherein the bore passes through the head from the bottom surface to an upper surface.

The putter 10 disclosed as the invention contains the head having a bore 44 entering the head bottom surface 36. The diameter of the bore is approximately but less than that of the golf ball 14. The bore entrance at the head bottom surface 36 is perpendicular to the bottom surface 36 and forms a cylindrical hole with in the head 22 as illustrated in FIG. 4. The depth 48 of the bore into the head 22 is approximately equal to but greater than the radius of the golf ball 14. FIG. 5 illustrates the ball 14 removably affixed within the bottom surface 36 and partially extended into the bore 44. A gap 52 exists in the preferred embodiment between the ball 14 and the head 22 inside the bore 44. The bore 44 penetrates the head 22 in an alternate embodiment and extends to the upper surface 34 of the head 22 as shown in FIG. 7. The ball 14 is struck from a front surface 38 of the head 22. The drawings are illustrative of putters 10 used by a right handed golfer 12. The shaft 20 is affixed to an opposite side of the head 22 for the left handed golfer. As illustrated in FIG. 4, the head 22 is defined by the upper 34, bottom 36 and front surfaces 38 as described. In addition, the head 22 contains a toe 40 and a heel 42. In the preferred embodiment, the shaft 20 is affixed near the heel 42 but alternate locations on the head 22 are anticipated for varying designs. FIG. 6 is a view of the bottom surface 36 showing the relationship of the bore 44 to the shaft 20 in the preferred embodiment.

Figure 8:
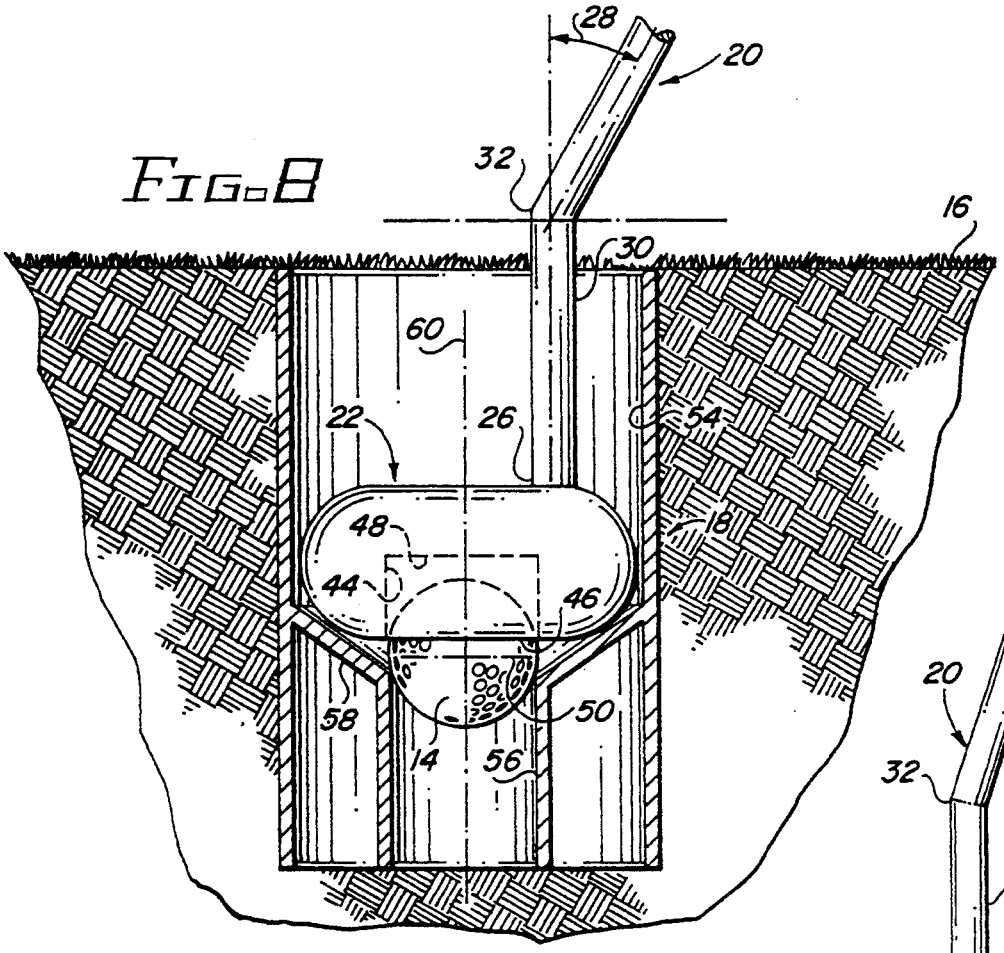
FIG. 8 is a partial cross-sectional view illustrating the putter invention affixing to the golf ball at rest within the cup, the ball being cradled in the cup center.

In addition to the bore 44 in the bottom surface 36 of the head 22, the invention discloses the vertical portion 30 of the shaft distal end 26. The length of the vertical portion 30 is sufficient to permit the head bottom surface 36 to reach and removably affix the golf ball 14 within the bore 44. Reference to FIG. 8 will further illustrate a challenge. The cup 18 on a putting green holds a flag staff and flag to identify the location of the cup on the green. The flag staff end is held with a receptacle 56 at the base 62 of the cup 18. The receptacle 56 is cylindrical in shape and is held along the center axis of the cup by support members 58. During the putting process, the flag is removed and the ball 50 is cradled within the receptacle 56 at the base 62 of the cup as illustrated in FIG. 8. The bottom surface 36 is held in a horizontal position by the vertical portion 30 of the shaft distal end 26 so as to affix to the ball 14 as it rests in its cradled position. The head is dimensioned to fit within the cup 18 without being interfered with by the cup wall 54. The bore, the receptacle, and the cup axes 60 align. The vertical portion 30 is held parallel to these axes 60 as the head is lowered into the cup 18. The ball is held above the cup base 62 in its cradled position over the receptacle 56 permitting the bottom surface 36 to affix the ball 14 within the bore 44. The length of the vertical portion is sufficient to extend the vertical portion above the green surface 16 when the head 22 is lowered into the cup 18 having a ball 14 resting at the base 62. The bend is just at the green surface 16 in the preferred embodiment, but is anticipated to be higher for various putter configurations.

Figure 9:
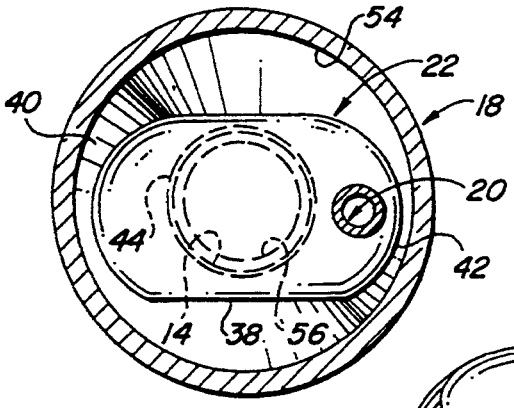
FIG. 9 is a partial top view of the putter invention affixing to the golf ball at rest within the cup.

The outside dimensions of the head 22 as defined from heel 42 to toe 40 is the largest head dimension in the preferred embodiment and is less than the diameter of the cup 54. The precise size is not critical and differs for various putter designs. The cup 18 is cylindrical in shape with an accepted diameter of 4.25 inches. The ball 14 has an official size of 1.68 inches in the United States. The bore 44 has a diameter slightly less than 1.68 inches in the preferred embodiment. The various embodiments anticipated for the head 22 adhere to the cup 18 and ball 14 limiting dimensions. FIG. 9 illustrates the relationship of the ball 14, cup 18 and head 22 as viewed from above the cup 18.

Figure 10:
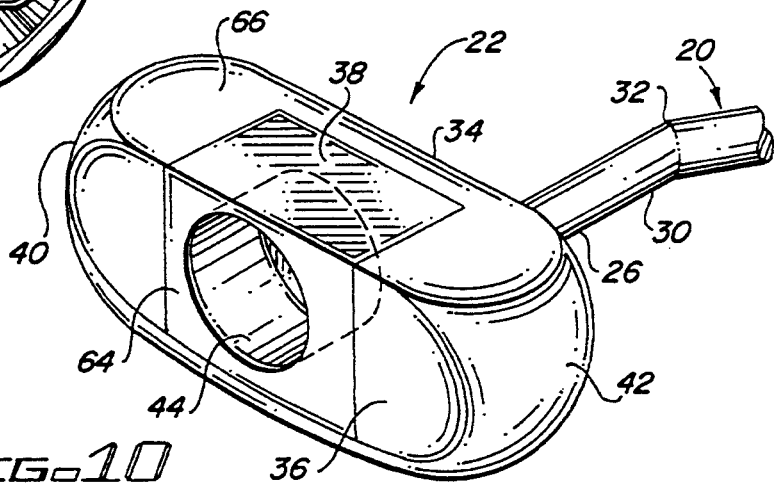
FIG. 10 is a partial perspective view of the preferred embodiment showing an insert containing a bore and front surface of the putter head.

FIG. 10 is a perspective view of the preferred embodiment. The preferred embodiment includes an insert 64 placed within the head 22. The insert is made of brass and contains a precision sized bore 44 having a diameter such that the ball 14 makes contact with the bore 44 just off of the ball center line 50 as illustrated in FIG. 8. A molded head 66 is set around the insert 64 in a mallet styled putter design. The brass material squeezes the ball 14 enough to provide an effective positioning of the ball 14 within the bore 44 during the process of retrieving the ball 14 from the cup 18. By using an insert 64 made of a softer material than the ball cover, the ball 14 will have the effect of expanding the bore 44 resulting in a similar squeezing effect. A weighted putter head 22 is desirable by many golfers 12. The brass insert 64 also provides this desired weight.

The present golf putter 10 can be made of any material desired and into various styled putter heads, but typically, standard steel or aluminum shafts 20 could be utilized with the putter head 22 made of brass, bronze, steel or any other material, but which would normally be a cast metal. However, any material desired can be used without departing from the spirit and scope of the invention. Accordingly, the present invention is not to be construed as limited to the forms disclosed herein except where specifically identified and disclosed as limiting since these are to be regarded as illustrative rather than restrictive.

What is claimed is:

1. A putter useful to a golfer retrieving a golf ball from within a golf green putting cup, said putter comprising:

a club shaft having a proximal gripping end and a distal end, the distal end having a shaft vertical portion, the shaft gripping end extending away from the vertical portion at an angle thereto;

a club head having a front surface, the head dimensioned to fit within the cup, the head having an upper surface and a bottom surface, the upper surface affixed to the shaft distal end with the vertical portion set substantially perpendicular to the head upper surface; and a cylindrical insert within an opening in the bottom surface, the insert having a lower edge generally coextensive with the bottom surface of the club head, the insert having a bore with a uniform diameter dimensioned to be slightly smaller than the diameter of a golf ball to be retrieved thereby by forcibly receiving and holding the golf ball.

2. The putter as recited in claim 1, wherein the head is a material molded around the insert, the shaft affixed to the molded material at the shaft distal end.

3. The putter as recited in claim 1, wherein the insert is a brass material having the bore.

4. The putter as recited in claim 1, wherein the insert includes the front surface.

* * * * *